US006463240B2

(12) United States Patent
Onuki et al.

(10) Patent No.: US 6,463,240 B2
(45) Date of Patent: Oct. 8, 2002

(54) POTENTIAL CONTROLLING METHOD AND POTENTIAL CONTROLLER OF IMAGE FORMING APPARATUS

(75) Inventors: Tomio Onuki; Junichi Hama, both of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/789,923

(22) Filed: Feb. 22, 2001

(65) Prior Publication Data

US 2001/0024579 A1 Sep. 27, 2001

(30) Foreign Application Priority Data

Feb. 25, 2000 (JP) ..... 2000-049143

(51) Int. Cl.[7] ..... G03G 15/08; G03G 15/00
(52) U.S. Cl. ..... 399/234; 399/128; 399/325
(58) Field of Search ..... 399/50, 55, 98, 399/128, 234, 235

(56) References Cited

U.S. PATENT DOCUMENTS 5,652,953 A * 7/1997 Imai ..... 399/98

FOREIGN PATENT DOCUMENTS

JP 7-253693 10/1995

JP 9-329946 12/1997

* cited by examiner

*Primary Examiner*—Joan Pendegrass
(74) *Attorney, Agent, or Firm*—Morgan, Lewis & Bockius LLP

(57) ABSTRACT

There is provided a potential controlling method and potential controller of an image forming apparatus, which can certainly prevent toner and carrier from adhering to the surface of an image bearing body at the time of start and stop of image formation and which can also be applied to an image forming apparatus having a high image forming speed. In the potential controller, at the time of rising or falling of a charged potential of the image bearing body and a developing bias voltage, at least one of the charged potential of the image bearing body and the developing bias voltage is controlled to an objective value through plural stages with the rising or falling of the other occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value.

20 Claims, 10 Drawing Sheets

| | | | | | | | |
|---|---|---|---|---|---|---|---|
| Vcln | 100V GOOD | 200V GOOD | 250V GOOD | 300V GOOD | 400V GOOD | 450V GOOD | 500V BAD |
| Vimg | 600V BAD | 500V BAD | 450V GOOD | 400V GOOD | 300V GOOD | 250V GOOD | 200V GOOD |

GOOD: THERE IS NO PROBLEM IN ADHESION OF TONER AND CARRIER

BAD: THERE IS A PROBLEM IN ADHESION OF TONER AND CARRIER

POTENTIAL CONTROLLING METHOD AND POTENTIAL CONTROLLER OF IMAGE FORMING APPARATUS

BACKGROUND OF THE INVENTION

1. Field of the Invention

The present invention relates to a potential controlling method and potential controller of an image forming apparatus, such as a copying machine, a printer, or a facsimile, using an electrophotographic system, and particularly to a potential controlling method and potential controller of an image forming apparatus, which can certainly prevent a picture quality defect or the like caused by adhesion of toner or carrier to the surface of an image bearing body at the time of rising or falling of a charged potential of the image bearing body and a developing bias voltage.

2. Description of the Related Art

Conventionally, an image forming apparatus, such as a copying machine, a printer, or a facsimile, using the electrophotographic system is constructed such that after the surface of a photoreceptor drum is charged to a predetermined potential, the image exposure of the surface of the photoreceptor drum is carried out to form an electrostatic latent image, and the electrostatic latent image is developed by a developing unit, so that a desired image is formed.

In the image forming apparatus like this, at the time of start of charging of the photoreceptor drum, as shown in FIG. 9A, when a non-charged region of the surface of the photoreceptor drum which is not charged is moved to a development position facing a developing roll of the developing unit as the photoreceptor drum is rotated, and when a developing bias voltage Vdc is applied to the developing roll, an electric field in the direction to move toner from the developing roll to the surface of the photoreceptor drum is formed between the photoreceptor drum and the developing roll by a potential difference Vimg between the developing bias voltage Vdc and the potential of the non-charged region of the photoreceptor drum, that is, 0 V. Thus, the toner or the toner and carrier in a developer adhere to the surface of the photoreceptor drum.

Besides, in the above image forming apparatus, at the time of start of charging of the photoreceptor drum, as shown in FIG. 9C, when a charged region of the surface of the photoreceptor drum is moved to the development position facing the developing roll of the developing unit as the photoreceptor drum is rotated, and when the developing bias voltage Vdc of the developing roll remains OFF, an electric field in the direction to move the carrier charged with reverse polarity of the toner from the developing roll to the surface of the photoreceptor drum is formed between the photoreceptor drum and the developing roll by a potential difference between a charged potential Vh of the photoreceptor drum and 0 V of an OFF potential of the developing bias voltage. Thus, the carrier immediately adheres to the charged region of the surface of the photoreceptor drum by the above electric field.

The adhesion phenomenon of the toner and the carrier occurs not only at the time of start of charging of the photoreceptor drum as the time of start of image formation, but also at the time of stop of charging of the photoreceptor drum as the time of end of image formation with the same reason as the above.

Like this, when the toner and the carrier adhere to the surface of the photoreceptor drum, in the image forming apparatus using an intermediate transfer belt, there have been problems that the photoreceptor drum, the intermediate transfer belt or the like is fouled or damaged, and in the region where the carrier adheres to the surface of the photoreceptor drum, transfer of a toner image is not excellently carried out, so that a defect in picture quality, such as a white point or white streak on a printed sheet, is caused.

As a technique which can solve the problems caused from the adhesion of the toner and the carrier to the surface of the photoreceptor drum at the time of start or stop of image formation, there has been already proposed a technique disclosed in Japanese Patent Unexamined Publication No. Hei. 9-329946 or No. Hei. 7-253693.

An image forming apparatus of the foregoing Japanese Patent Unexamined Publication No. Hei. 9-329946 includes a charging part including a charging member for uniformly charging the surface of an image bearing body and a charging power source for applying a voltage to the charging member, an exposure part for attenuating the potential of the surface of the image bearing body charged by the charging part with image exposure to form an electrostatic latent image on the image bearing body, and a developing part including a developer bearing body for bearing a two-component developer containing a toner charged in the same polarity as the charging polarity of the charging part and a carrier charged in the reverse polarity to the charging polarity, and a developing bias power source for applying a developing bias voltage of the same polarity as the charging polarity to the developer bearing body, and the image forming apparatus further includes a control part for controlling the turning ON/OFF of the charging power source and the developing bias voltage power source so that application of the developing bias voltage to the developer bearing body starts when the end portion of charging start of the surface of the image bearing body faces the developer bearing body, and the application of the developing bias voltage is stopped when the end portion of charging stop of the surface of the image bearing body faces the developer bearing body, and the ON/OFF timing of the charging power source and the developing bias power source is set so as to make the value of the potential of the surface of the image bearing body approach the developing bias voltage under the condition that the absolute value of the potential of the surface of the image bearing body, which passes through the facing position to the developer bearing body, becomes equal to or less than the absolute value of the developing bias voltage when the developing bias voltage is transiently changed by ON/OFF of the developing bias power source.

A potential control method in an image forming apparatus of Japanese Patent Unexamined Publication No. Hei. 7-253693 uses a two-component developer made of a toner and a carrier, and in an image forming apparatus in which the toner is made to adhere to a photoreceptor by applying a developing bias voltage to a developing sleeve, both the surface potential of the photoreceptor and the developing bias are controlled in stages at the time of start and stop of the rotation of the photoreceptor.

However, the foregoing prior art has problems as follows. That is, in the case of the foregoing image forming apparatus of Japanese Patent Unexamined Publication No. Hei. 9-329946, the ON/OFF timing of the charging power source and the developing bias power source is set so as to make the value of the potential of the surface of the image bearing body approach the developing bias voltage under the condition that the absolute value of the potential of the surface of the image bearing body, which passes through the facing position to the developer bearing body, becomes equal to or less than the absolute value of the developing bias voltage when the developing bias voltage is transiently changed by ON/OFF of the developing bias power source. Thus, as shown in FIG. 9B, if the timing of the charged potential of the image bearing body is coincident with that of the developing bias voltage at the developing position, any problem does not occur. However, the charging power source and the developing bias power source have difference and fluctuation in rising/falling speed, and the image bearing body also has rotation variation or the like. Thus, there have been problems that it is difficult to make the timing of the charged potential of the image bearing body coincident with that of the developing bias voltage at the developing position, and it is difficult to certainly prevent the toner and carrier from adhering to the surface of the image bearing body at the time of start and stop of the image formation. The problems become more remarkable when the rotation speed of the image bearing body becomes high and the process speed becomes high.

In the case of the potential control method in the image forming apparatus of Japanese Patent Unexamined Publication No. Hei. 7-253693, both the surface potential of the photoreceptor and the developing bias are controlled in stages at the time of start and stop of the rotation of the photoreceptor. However, with the same reason as the technique of Japanese Patent Unexamined Publication No. Hei. 9-329946, there has been a problem that it is difficult to certainly perform the control in stages of both the surface potential of the photoreceptor and the developing bias at the time of start and stop of the rotation of the photoreceptor. Further, in the case of the potential control method in the image forming apparatus of Japanese Patent Unexamined Publication No. Hei. 7-253693, since both the surface potential of the photoreceptor and the developing bias are controlled in stages, in view of the difference and fluctuation in the rising/falling speed of the charging power source and the developing bias power source, the rotation variation of the photoreceptor, and the like, there has been a problem that the control in stages of both the surface potential of the photoreceptor and the developing bias takes a long time, and it is hard to apply the method to an image forming apparatus having a high printing speed.

SUMMARY OF THE INVENTION

The present invention has been made in view of the above circumstances and provides a potential controlling method and potential controller of an image forming apparatus, which can certainly prevent toner and carrier from adhering to the surface of an image bearing body at the time of start and stop of image formation, and can also be applied to an image forming apparatus having a high image forming speed.

According to an aspect of the present invention, in an image forming apparatus which forms an image by charging an image bearing body with a charging part, by performing image exposure to the surface of the image bearing body to form an electrostatic latent image, and by applying a developing bias voltage to a developer bearing body of a developing part to develop the electrostatic latent image, a potential controller of the image forming apparatus is constructed such that at the time of rising or falling of a charged potential of the image bearing body and a developing bias voltage, at least one of the charged potential of the image bearing body and the developing bias voltage is controlled to an objective value through plural stages with the rising or falling of the other occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value.

At the time of the rising or falling of the charged potential of the image bearing body and the developing bias voltage, at least one of the charged potential of the image bearing body and the developing bias voltage is controlled as described above. However, more preferably, at both the rising and falling of the charged potential of the image bearing body and the developing bias voltage, at least one of the charged potential of the image bearing body and the developing bias voltage is controlled as described above. Thus, at least one of the time of the rising and the time of the falling of the charged potential of the image bearing body and the developing bias voltage, at least one of the charged potential of the image bearing body and the developing bias voltage is controlled as described above.

According to another aspect of the present invention, in the above potential controller of the image forming apparatus, a potential controlling method controls, at the time of rising or falling of a charged potential of the image bearing body and a developing bias voltage, at least one of the charged potential of the image bearing body and the developing bias voltage to reach an objective value through plural stages with the rising or falling of the other occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Embodiments of the present invention will be described below with reference to the drawings.

Embodiment 1

Figure 2:
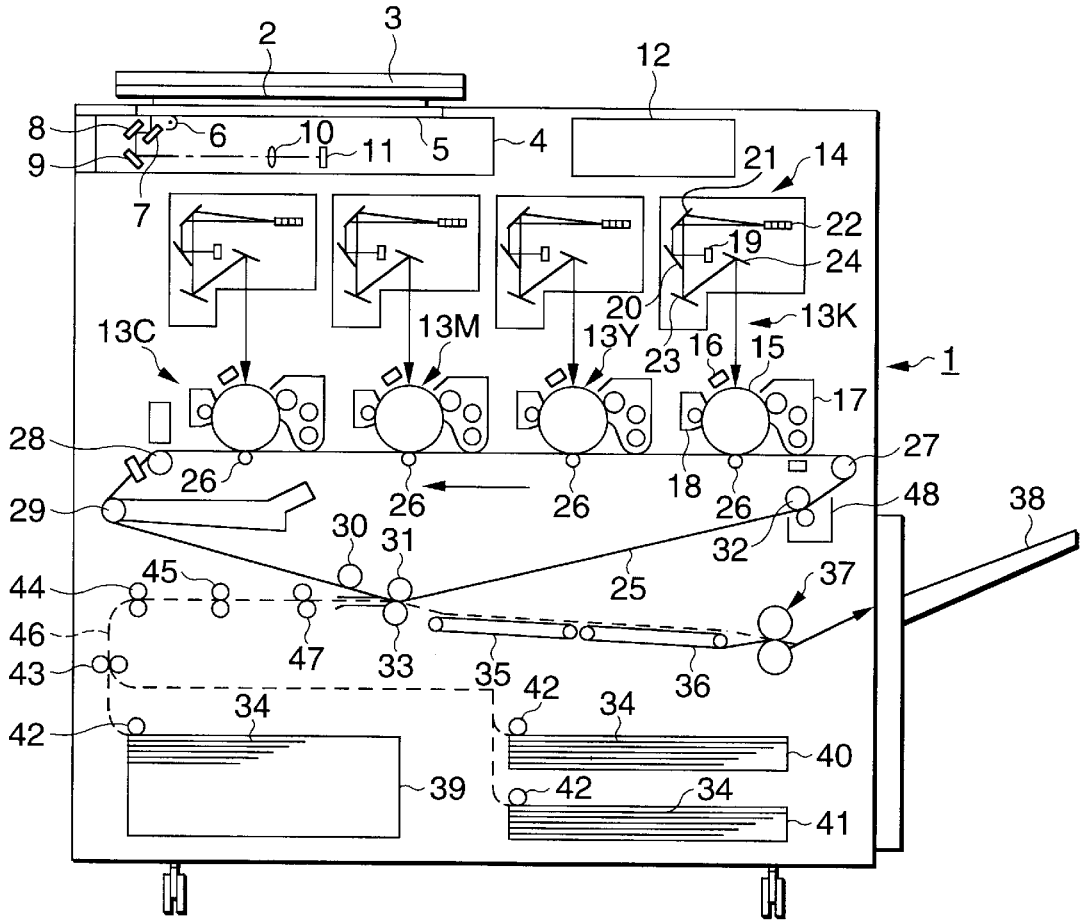
FIG. 2 is a structural view showing a digital color copying machine as an image forming apparatus to which the potential controller of the image forming apparatus according to the embodiment 1 of the present invention is applied.

FIG. 2 is a total structural view showing a tandem type digital color copying machine as an image forming apparatus of embodiment 1 of the present invention.

In FIG. 2, reference numeral 1 designates a main body of the tandem type digital color copying machine, and an image reading device 4 for reading an image of an original document 2 is provided at an upper part of one end side (in the drawing, left end side) of the main body 1 of the digital color copying machine. In the inside of the main body 1 of the digital color copying machine, image forming units 13K, 13Y, 13M and 13C of respective colors of black (K), yellow (Y), magenta (M) and cyan (C) are disposed at constant intervals in the horizontal direction. Further, under the four image forming units 13K, 13Y, 13M and 13C, an intermediate transfer belt 25 for transferring the respective color toner images, which are sequentially formed by the image forming units, in a state where they are superposed on each other is disposed rotatably in the direction of an arrow. The toner images of the respective colors transferred onto the intermediate transfer belt 25 so as to be superimposed on each other are collectively transferred onto a transfer sheet 34 as a transfer member fed from a paper feeding cassette 39 or the like, and then, they are fixed onto the transfer sheet 34 by a fixing unit 37 and the sheet is ejected to the outside.

Incidentally, here, although the structure of the present invention will be described using the tandem type color electrophotographic copying machine, the present invention is also effective in a color printer/facsimile.

Next, the structure of the tandem type color electrophotographic copying machine as the image forming apparatus of the embodiment 1 of the present invention will be described in more detail with reference to FIG. 2.

In FIG. 2, reference numeral 1 designates the main body of the tandem type digital color copying machine. A platen cover 3 for pressing the original document 2 onto a platen glass 5 and the image reading device 4 for reading an image of the original document 2 put on the platen glass 5 are disposed at the upper part of one end side (in the drawing, left end side) of the main body 1 of the digital color copying machine. The image reading device 4 is constructed such that the original document 2 put on the platen glass 5 is illuminated by a light source 6, a reflected light image from the original document 2 is scanned and exposed onto an image reading element 11 made of CCDs or the like through a reducing optical system made of a full rate mirror 7, half rate mirrors 8 and 9, and an imaging lens 10, and the coloring material reflected light image of the original document 2 is read by the image reading element 11 at a predetermined dot density (for example, 16 dots/mm).

The coloring material reflected light image of the original document 2 read by the image reading device 4 is sent, as three color original document reflectivity data of, for example, red (R), green (G) and blue (B) (each having 8 bits), to an IPS (Image Processing System) 12. In this IPS 12, predetermined image processing such as shading correction, position deviation correction, brightness/color space conversion, gamma correction, frame erasure, or color/movement edition is carried out to the reflectivity data of the original document 2.

Then, the image data subjected to the predetermined image processing by the IPS 12 are converted into original document coloring material gradation data of four colors of yellow (Y), magenta (M), cyan (C), and black (K) (each having 8 bits), and as described below, are sent to ROSes (Raster Output Scanner) 14K, 14Y, 14M, and 14C as image exposure parts of the image formation units 13K, 13Y, 13M and 13C of the respective colors of black (K), yellow (Y), magenta (M), and cyan (C). In the ROSes 14K, 14Y, 14M and 14C, image exposure by a laser beam is performed in accordance with the original document coloring material gradation data of a predetermined color.

In the inside of the tandem type digital color copying machine, as described above, the four image forming units 13K, 13Y, 13M and 13C of black (K), yellow (Y), magenta (M), and cyan (C) are disposed in parallel in the horizontal direction at constant intervals.

All these four image forming units 13K, 13Y, 13M and 13C are constructed in the same way, and each is roughly constituted by a photoreceptor drum 15 rotating at a predetermined rotation speed in the direction of an arrow, a primary charging scorotron 16 as a charging part for uniformly charging the surface of the photoreceptor drum 15, a ROS 14 for forming an electrostatic latent image by exposing images corresponding to the respective colors onto the surface of the photoreceptor drum 15, a developing unit 17 as a developing part for developing the electrostatic latent image formed on the photoreceptor drum 15, and a cleaning device 18.

As shown in FIG. 2, the ROS 14 modulates a semiconductor laser 19 in accordance with the original document coloring material gradation data, and a laser beam LB is emitted from this semiconductor laser 19 in accordance with the gradation data. The laser beam LB emitted from the semiconductor laser 19 is deflected and scanned by a rotary polygon mirror 22 through reflecting mirrors 20 and 21, and is again scanned and exposed onto the photoreceptor drum 15 as an image bearing body through the reflecting mirrors 20 and 21, and a plurality of reflecting mirrors 23 and 24.

The image data of the respective colors are sequentially outputted from the above IPS 12 to the ROSes 14K, 14Y, 14M and 14C of the image forming units 13K, 13Y, 13M and 13C of the respective colors of black (K), yellow (Y), magenta (M) and cyan (C). The laser beams LB emitted from the ROSes 14K, 14Y, 14M and 14C in accordance with the image data are scanned and exposed onto the surfaces of the photoreceptor drums 15K, 15Y, 15M and 15C, so that the electrostatic latent images are formed. The electrostatic latent images formed on the respective photoreceptor drums 15K, 15Y, 15M and 15C are developed, as toner images of the respective colors of black (K), yellow (Y), magenta (M) and cyan (C), by developing units 17K, 17Y, 17M and 17C.

The toner images of the respective colors of black (K), yellow (Y), magenta (M) and cyan (C) sequentially formed on the photoreceptor drums 15K, 15Y, 15M and 15C of the respective image forming units 13K, 13Y, 13M and 13C are transferred so as to be superposed on each other onto the intermediate transfer belt 25 as an intermediate transfer body disposed under the respective image forming units 13K, 13Y, 13M and 13C by primary transfer rolls 26K, 26Y, 26M and 26C. This intermediate transfer belt 25 is stretched on a driving roll 27, a striping roll 28, a steering roll 29, an idle roll 30, a backup roll 31, and an idle roll 32 by a constant tension, and is circularly driven in the direction of the arrow at a predetermined speed by the driving roll 27 rotated by a not-shown dedicated driving motor with an excellent constant speed property. As the above transfer belt 25, for example, a synthetic resin film of polyimide having flexibility is formed into a band-like body, both ends of the synthetic resin film formed into the band-like body are connected by welding or the like, and the thus formed endless belt-like body is used.

The toner images of black (K), yellow (Y), magenta (M) and cyan (C) transferred onto the intermediate transfer belt 25 so as to be superposed on each other are secondary transferred onto the transfer sheet 34 through pressing force and electrostatic force by a secondary transfer roll 33 brought into press contact with the backup roll 31. The transfer sheet 34 on which the toner images of the respective colors are transferred is conveyed to the fixing unit 37 by two conveying belts 35 and 36. The transfer sheet 34 on which the toner images of the respective colors are transferred is subjected to fixation processing through heat and pressure by the fixing unit 37, and is ejected onto an ejection tray 38 provided at the outside of the main body 1 of the copying machine.

As shown in FIG. 2, the transfer sheet 34 with a predetermined size is once conveyed from any one of a plurality of paper feeding cassettes 39, 40 and 41 through a sheet conveying passage 46 made of a sheet feeding roll 42 and paper conveying roll pairs 43, 44 and 45 to a registration roll 47 and is stopped. The transfer sheet 34 supplied from any one of the paper feeding cassettes 39, 40 and 41 is sent onto the intermediate transfer belt 25 by the registration roll 47 rotated at a predetermined timing.

In the four image forming units 13K, 13Y, 13M and 13C of black, yellow, magenta and cyan, as described above, the toner images of black, yellow, magenta and cyan are sequentially formed at a predetermined timing.

Incidentally, with respect to the photoreceptor drums 15K, 15Y, 15M and 15C, after the transfer step of the toner images is ended, residual toner, paper powder and the like are removed by cleaning devices 18K, 18Y, 18M and 18C, and preparation for a next image forming process is made. Besides, residual toner, paper powder and the like of the intermediate transfer belt 25 are removed by a cleaner 48 for a belt.

Figure 3:
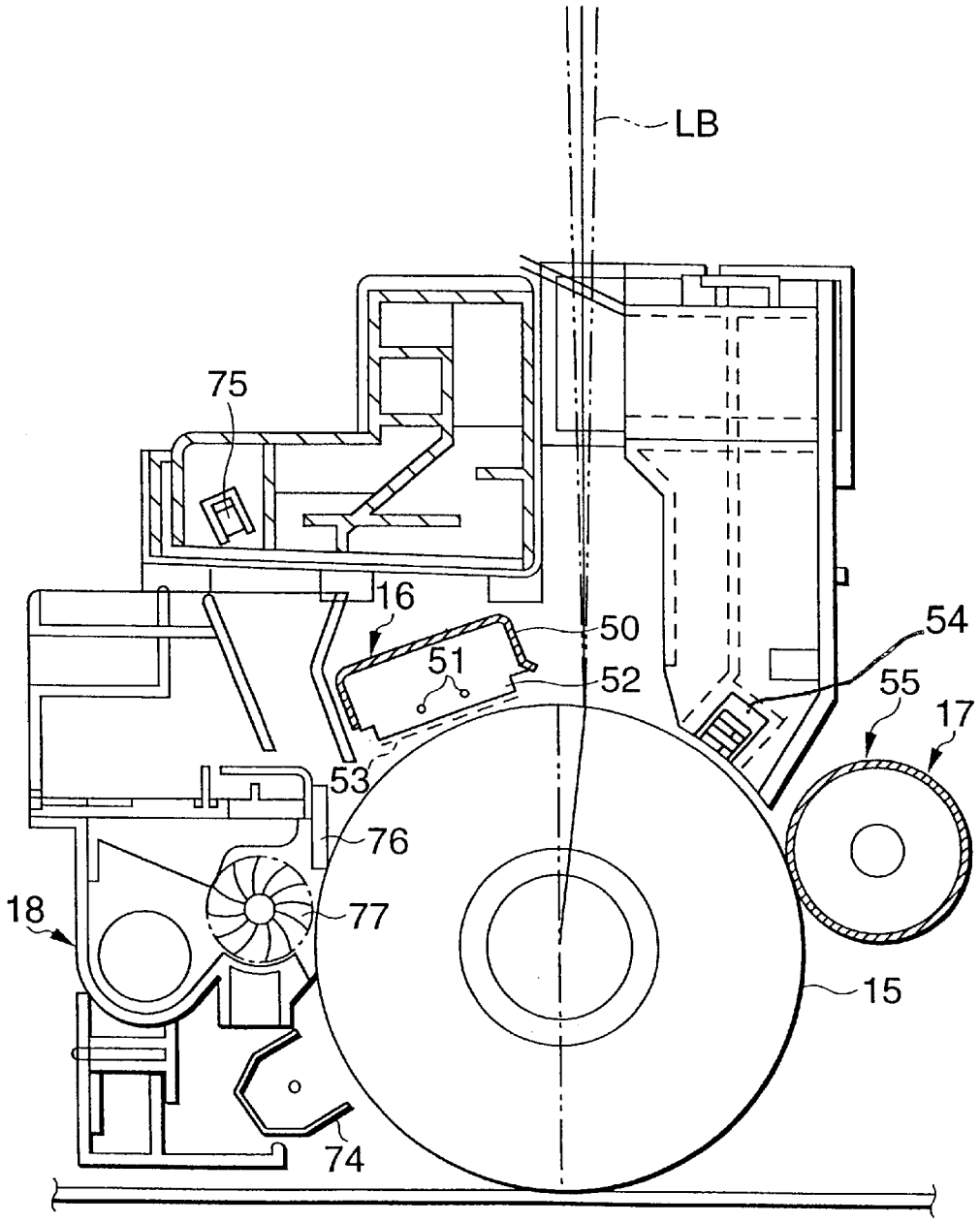
FIG. 3 is a structural view showing an image forming unit of the digital color copying machine as the image forming apparatus to which the potential controller of the image forming apparatus according to the embodiment 1 of the present invention is applied.
Figure 4:
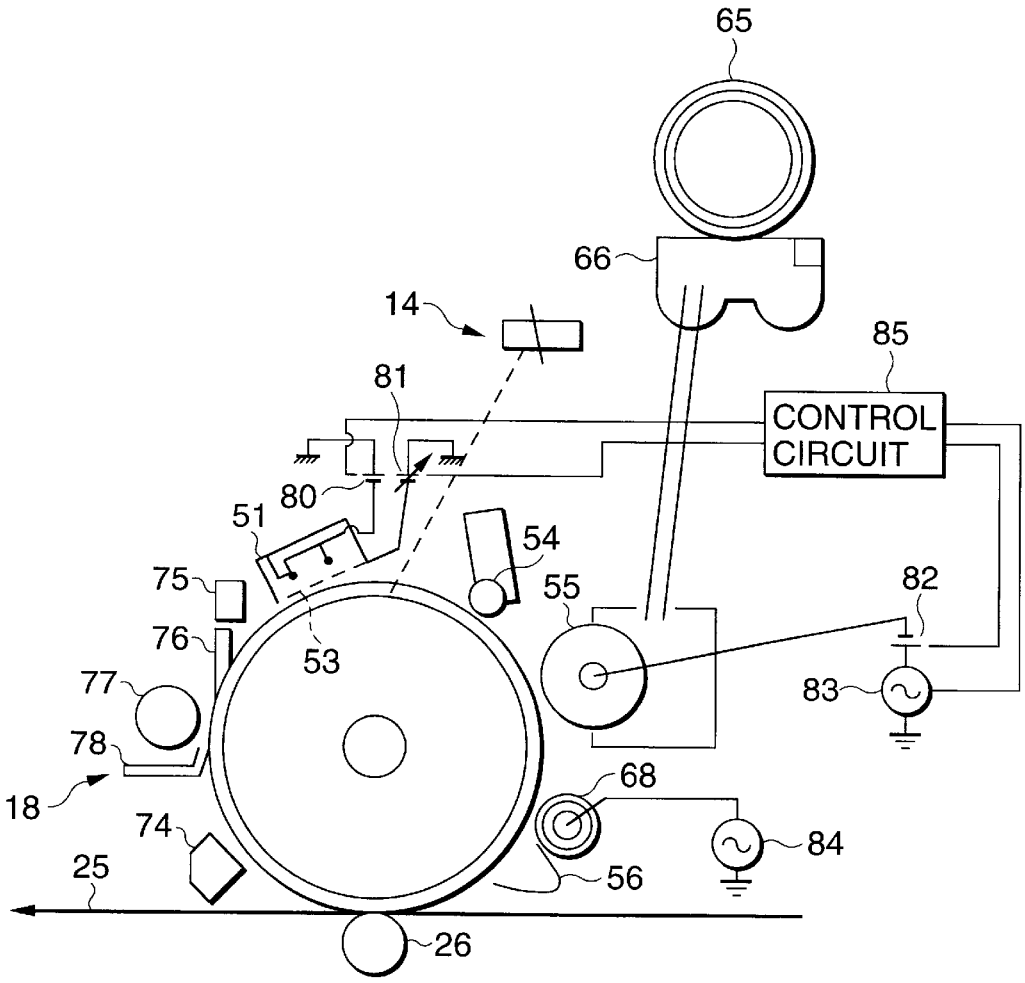
FIG. 4 is a schematic view showing the image forming unit of the digital color copying machine as the image forming apparatus to which the potential controller of the image forming apparatus according to the embodiment 1 of the present invention is applied.

FIGS. 3 and 4 show the respective image forming units of the digital color copying machine.

As shown in FIGS. 3 and 4, all the four image forming units 13K, 13Y, 13M and 13C of black, yellow, magenta and cyan are constructed in the same way. The four image forming units 13K, 13Y, 13M and 13C are constructed such that as described above, the toner images of black, yellow, magenta and cyan are sequentially formed at the predetermined timing. Each of the image forming units 13K, 13Y, 13M and 13C of the respective colors includes the photoreceptor drum 15 as described above, and the surface of the photoreceptor drum 15 is uniformly charged to a predetermined potential (for example, −700 V) by the primary charging scorotron 16. The primary charging scorotron 16 is constituted by a discharge shield 50 formed into a frame body having a rectangular section open at the side of the photoreceptor drum 15, two discharge wires 51 extended in the discharge shield 50, and a grid electrode 53 disposed outside of an opening portion 52 of the discharge shield 50.

After the surface of the photoreceptor drum 15 is uniformly charged by the primary charging scorotron 16, it is subjected to scanning and exposure of the laser beam LB for image formation emitted from the ROS 14 in accordance with the image data, so that electrostatic latent images corresponding to the respective colors are formed. Incidentally, in the embodiment shown in the drawings, a potential sensor 54 for measuring the surface potential of the photoreceptor drum 15 is disposed at the downstream side of the image exposure position of the surface of the photoreceptor drum 15.

The electrostatic latent images formed on the photoreceptor drum 15 are developed with toners of the respective colors of yellow, magenta, cyan and black by the developing rolls 55 of the developing units 17 of the respective image forming units 13K, 13Y, 13M and 13C and are made visible toner images. These visible toner images are sequentially transferred so as to be superposed on each other onto the intermediate transfer belt 25 by charging of the primary transfer roll 26. Incidentally, in the embodiment shown in the drawings, the toner image developed on the photoreceptor drum 15 is charged by a pre-transfer corotron 56 before it is transferred onto the intermediate transfer belt 25, so that transfer efficiency is improved.

Figure 5:
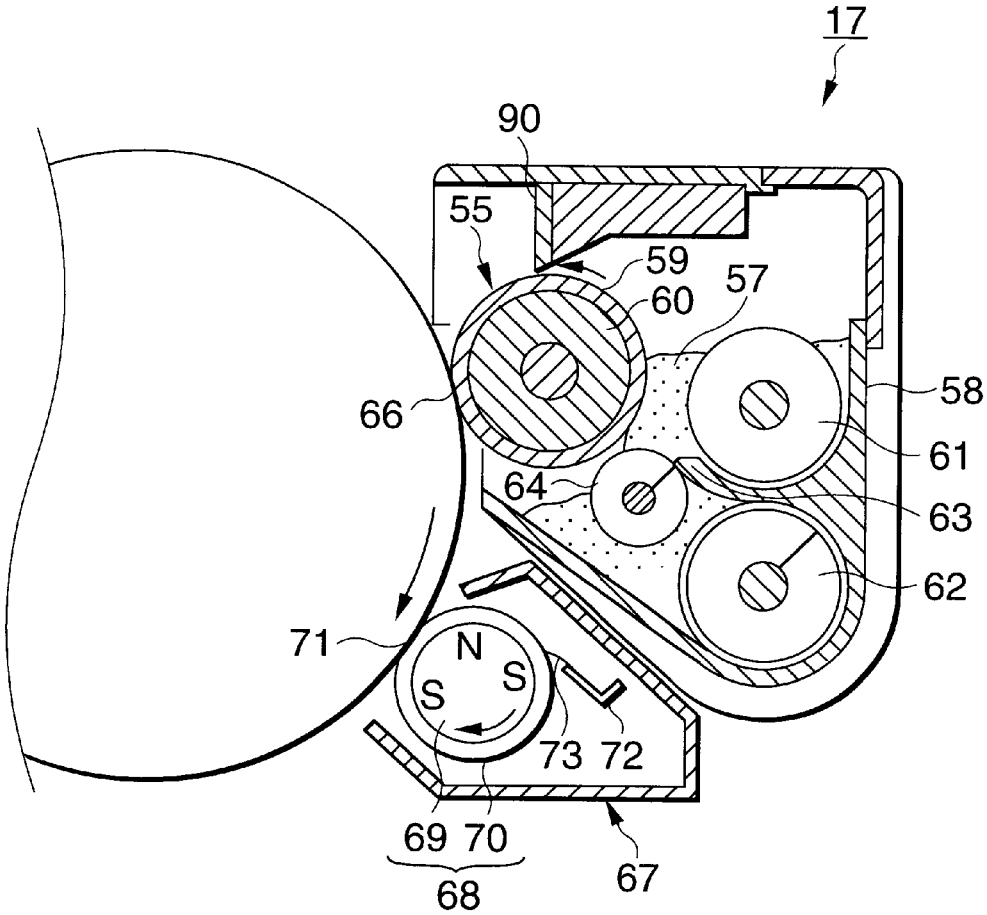
FIG. 5 is a structural view showing a developing unit.

Besides, as shown in FIG. 5, the developing unit 17 for developing the electrostatic latent image formed on the photoreceptor drum 15 includes a developing unit housing 58 containing a two-component developer 57 made of a toner and a carrier. The developing roll 55 as a developer bearing body is disposed at an opening portion of the developing unit housing 58 at the side of the photoreceptor drum 15. The developing roll 55 is constituted by a developing sleeve 59 rotated at a predetermined speed and a magnet roll 60 disposed in the inside of the developing sleeve 59 in a fixed state. Further, in the inside of the developing unit housing 58, first and second two developer conveying augers 61 and 62 are disposed to vertically face each other at the back side of the developing roll 55. A partition plate 63 is provided between the two developer conveying augers 61 and 62 to substantially horizontally project toward the side of the developing roll 55. Besides, a third small diameter developer conveying auger 64 is disposed obliquely below the upper developer conveying auger 62.

In the inside of the developing unit housing 58, as shown in FIG. 4, a toner is supplied from a toner cartridge 65 through a reserve tank 66 at a predetermined timing. As shown in FIG. 5, the toner supplied from the toner cartridge 65 is sent to one end portion of the first developer conveying auger 61 in the axial direction, is conveyed in the axial direction of the first developer conveying auger 61, and is friction charged while being stirred together with the developer 57 in the developing unit housing 58. Further, the toner conveyed to the end portion of the first developer conveying auger 61 in the axial direction and stirred together with the developer 57 in the developing unit housing 58 is delivered to the second developer conveying auger 62. While being conveyed in the axial direction of the second developer conveying auger 62, the toner is further sufficiently stirred together with the developer 57 in the developing unit housing 58 and is friction charged. The two-component developer 57 made of the toner and the carrier is supplied to the developing roll 55 from the second developer conveying auger 62 through the third developer conveying auger 64. After the developer 57 supplied to the developing roll 55 is attracted onto the surface of the developing sleeve 59 by magnetic force of the magneto roll 60, it is conveyed in the direction of an arrow with the rotation of the developing sleeve 59, and its layer thickness is regulated by a developer layer thickness regulating member 90. Then, the developer 57 is conveyed to a development position 66 facing the photoreceptor drum 15, and develops the electrostatic latent image formed on the surface of the photoreceptor drum 15.

Besides, as shown in FIG. 5, a carrier capture part 67 for removing the carrier adhered to the surface of the photoreceptor drum 15 is provided at the downstream side of the developing unit 17. The carrier capture part 67 includes a catch-up roll 68 disposed closely to the surface of the photoreceptor drum 15. The catch-up roll 68 is constituted, as shown in the drawing, by a magnet roll 69 which is magnetized to have magnetic poles of predetermined polarities at predetermined positions, and a catch-up sleeve 70 disposed rotatably in the direction of an arrow on the outer periphery of the magnet roll 69. At a capture position 71 of the photoreceptor drum 15, the catch-up roll 68 causes the carrier adhered to the surface of the photoreceptor drum 15 to adhere to the catch-up sleeve 70 by the magnetic force of the magnet roll 69. The carrier removed and collected by the catch-up sleeve 70 is scraped away by a blade 73 attached to a support member 72.

As shown in FIGS. 3 and 4, the electricity of the surface of the photoreceptor drum 15 after the transfer step of the toner image is ended is removed by a pre-cleaning corotron 74. Then, residual toner, paper powder, and the like are removed by the cleaning device 18, and the electricity is completely removed by exposure with an erase lamp 75, so that preparation for a next image forming process is made. The cleaning device 18 includes a cleaning blade 76, a cleaning brush 77, and a film seal 78, and the residual toner, paper powder, and the like on the photoreceptor drum 15 are removed by the cleaning blade 76 and the cleaning brush 77.

Besides, as shown in FIG. 2, residual toner, paper powder and the like are removed by the cleaning device 48 from the surface of the intermediate transfer belt 25 after the transfer step of the toner image is ended, so that preparation for the next image forming process is made. The cleaning device 48 includes a cleaning brush and a cleaning blade, and the residual toner, paper powder and the like on the intermediate transfer belt 25 are removed by the cleaning brush and the cleaning blade.

By the way, in this embodiment, at the time of rising or falling of a charged potential of the image bearing body and a developing bias voltage, at least one of the charged potential of the image bearing body and the developing bias voltage is controlled to an objective value through plural stages with the rising or falling of the other occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value.

Besides, in this embodiment, when the potential of the non-charged portion of the image bearing body is V0 (V), an intermediate value of the developing bias voltage controlled to the objective value through the plural stages is VDn (V) (n=1 or more), and the potential of the charged portion of the image bearing body is VH (V), the developing bias voltage is controlled to the objective value through the plural stages, so that the following relation is satisfied:

$$VH-VDn<450\ (V)$$

$$VDn-V0<450\ (V).$$

Further, in this embodiment, when an intermediate value of the charged potential of the image bearing body controlled to the objective value through the plural stages is VHn (V) (n=1 or more), the developing bias voltage is VD (V), and a potential when the developing bias voltage is turned OFF is VD0 (V), the charged potential of the image bearing body is controlled to the objective value through the plural stages, so that the following relation is satisfied:

$$VD-VHn<450\ (V)$$

$$VHn-VD0<450\ (V).$$

FIG. 4 shows the image forming unit of the digital color copying machine of the embodiment and the structure of a power source circuit as well.

In FIG. 4, reference numeral 80 designates a DC (direct current) high voltage power source for applying a DC voltage to the discharge wire 51 of the primary charging scorotron 16; 81, a DC high voltage power source for applying a variable DC voltage to the grid electrode 53 of the primary charging scorotron 16; 82, a DC high voltage power source for applying a variable DC bias voltage to the developing sleeve 59 of the developing roll 55; 83, an AC (alternating current) high voltage power source for applying an AC bias voltage superimposed on the DC bias voltage so as to be capable of turning ON/OFF; 84, an AC high voltage power source for applying an AC voltage to the catch-up sleeve of the catch-up roll 68; and 85, a control circuit for controlling the output timings and output values of the DC high voltage power source 80, the DC high voltage power source 81, the DC high voltage power source 82, and the AC high voltage power source 83.

In this embodiment, by the control circuit 85, at the time of rising and falling of the charged potential of the photoreceptor drum 15 and the developing bias voltage, at least one of the charged potential of the photoreceptor drum 15 and the developing bias voltage is controlled to the objective value through the plural stages with the rising or falling of the other occurring through the stages, so that the potential difference between the potential of the non-charged portion of the photoreceptor drum 15 and the developing bias voltage does not exceed the first predetermined value, and the potential difference between the potential of the charged portion of the photoreceptor drum 15 and the developing bias voltage does not exceed the second predetermined value.

In the foregoing structure, and in the tandem type digital color copying machine to which the potential controller of the image forming apparatus of this embodiment is applied, it is possible to certainly prevent toner and carrier from adhering to the surface of the image bearing body at the time of start or stop of image formation in the manner as described below, and this embodiment can also be applied to an image forming apparatus having a high image forming speed.

Figure 1A:
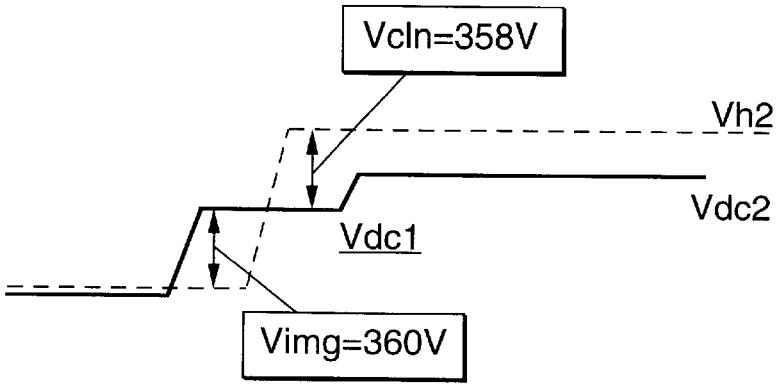
FIGS. 1A and 1B are timing charts respectively showing the operation of a potential controller of an image forming apparatus according to embodiment 1 of the present invention.

That is, in the digital color copying machine of this embodiment, in the case where formation of a full color or single color image is started, as shown in FIG. 4, with the start of the image forming operation, the rotation driving of the photoreceptor drum 15 is started, and DC voltage is applied to the primary charging scorotron 16 of each of the image forming units 13Y, 13M, 13C and 13K by the DC high voltage power source 80 and the DC high voltage power source 81, and the surface of the photoreceptor drum 15 is uniformly charged to a predetermined potential (for example, −700 V) as shown in FIG. 1A.

When the front end of a charged region of the photoreceptor drum 15 is moved to a developing region facing the developing roll 55 as the photoreceptor drum 15 is rotated, as shown in FIG. 1A, an intermediate value Vdc1 (for example, Vdc1=−360 V) of a developing bias voltage lower than a predetermined developing bias voltage is applied to the developing sleeve 59 of the developing unit 17 by the control circuit 85 at the timing earlier than the rising of the potential of the charged region of the photoreceptor drum 15. The intermediate value Vdc1 of the developing bias voltage is set so that the potential difference between the potential (substantially 0 V) of the non-charged portion of the photoreceptor drum 15 and the developing bias voltage Vdc1 does not exceed the first predetermined value, and the potential difference (−340 V) between the potential (−700 V) of the charged portion of the photoreceptor drum 15 and the developing bias voltage Vdc1 does not exceed the second predetermined value. In this embodiment, the intermediate value Vdc1 of the developing bias voltage is set to, for example, −360 V as described above.

Incidentally, this embodiment adopts a non-retract system in which the housing 58 of the developing unit 17 is not separated from the photoreceptor drum 15. A motor driving the developing unit 17 is in a stop state until an image is actually formed, and therefore, in the state shown in FIG. 1A, the developing roll 55 is in a stop state. Further, only the developing bias voltage of a predetermined DC component is applied to the developing sleeve 59 of the developing unit 17 in the non-image formation state as described above, and the developing bias voltage of an AC component is in an OFF state.

Thereafter, the control circuit 85 controls the DC high voltage power source 82 under the condition that the region of the intermediate value Vdc1 of the developing bias voltage exists at both sides of the rising portion of the charged region of the photoreceptor drum 15 and at a predetermined timing after the region of the intermediate value Vdc1 of the developing bias voltage passes the charged region of the photoreceptor drum 15, so that a predetermined developing bias voltage (for example, Vdc2=−550 V) is applied to the developing sleeve 59 of the developing unit 17.

A time in which the developing bias voltage is changed from the intermediate value Vdc1 to the objective predetermined developing bias voltage Vdc2 needs only to satisfy the condition that the intermediate value Vdc1 of the developing bias voltage has certainly passed the charged region of the photoreceptor drum 15, and this time T is set to, for example, 100 ms. As a result, in this embodiment, the developing bias voltage rises to the intermediate value Vdc1 earlier than the rising of the charged potential of the photoreceptor drum 15 by about 50 ms, and the developing bias voltage rises to the objective predetermined value later than the rising of the charged potential of the photoreceptor drum 15 by about 50 ms. Incidentally, it is needless to say that the time T may be shorter or longer than 100 ms.

The important point of this embodiment is that the developing bias voltage is changed from the intermediate value Vdc1 to the objective predetermined developing bias voltage Vdc2 with the rising of the charged potential of the photoreceptor drum 15 occurring while the intermediate value continues.

Figure 1B:
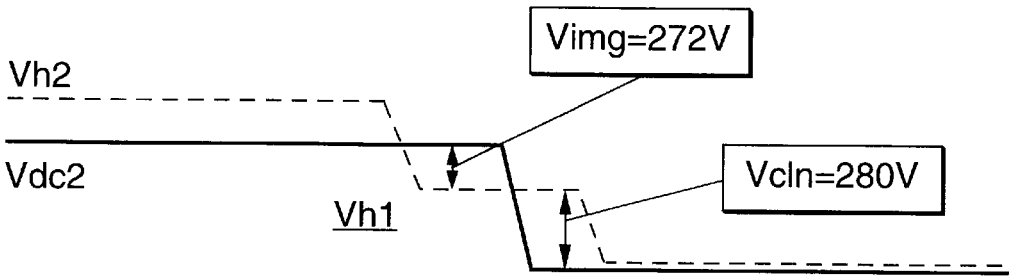

Besides, in the digital color copying machine of this embodiment, in the case where one job of full color or single color image formation is ended, as shown in FIG. 4, when the image forming operation is ended, the DC voltage and the DC voltage applied by the DC high voltage power source 80 and the DC high voltage power source 81 to the primary charging scorotron 16 of each of the image forming units 13Y, 13M, 13C and 13K are turned OFF, and charging to the surface of the photoreceptor drum 15 is finally stopped (0 V) as shown in FIG. 1B.

When the rear end of the charged region of the photoreceptor drum 15 is moved to the development region facing the developing roll 55 as the photoreceptor drum 15 is rotated, as shown in FIG. 1B, the potential of the primary charging scorotron 16 is changed by the control circuit 85 at the timing earlier than the falling of the developing bias voltage to an intermediate value Vh1 (for example, Vh1=−300 V) of the charged potential of the photoreceptor drum 15 lower than a predetermined charged potential. The intermediate value Vh1 of the charged potential of this photoreceptor drum 15 is set so that the potential difference between the potential (about 0 V) of the non-charged portion of the photoreceptor drum 15 and the intermediate value Vh1 (for example, Vh1=−300 V) of the charged potential of the photoreceptor drum 15 does not exceed the first predetermined value, and the potential difference (−250V) between the potential (−300 V) of the charged portion of the photoreceptor drum 15 and the developing bias voltage Vdc2 does not exceed the second predetermined value. In this embodiment, the intermediate value Vh1 of the charged potential of the photoreceptor drum 15 is set to, for example, −300 V as described above.

In this embodiment, although the photoreceptor drum 15 is in a rotating state until charging of the photoreceptor drum 15 is stopped and the application of the developing bias voltage is turned OFF, the developing roll 55 stops, and the application of the AC component of the developing bias voltage is also in an OFF state.

Thereafter, the control circuit 85 controls the DC high voltage power source 81 at a predetermined timing after the region of the intermediate value Vh1 of the charged potential of the photoreceptor drum 15 passes the region of the developing bias voltage Vdc2 with the falling portion of the developing bias voltage Vdc2 existing in the region of the intermediate value Vh1 of the charged potential of the photoreceptor drum 15, so that the voltage applied to the grid electrode 53 of the primary charging scorotron 16 is turned OFF (0 V).

A time in which the charged potential of the photoreceptor drum 15 is changed from the intermediate value Vh1 to 0 V needs only to satisfy the condition that the intermediate value Vh1 of the charged potential of the photoreceptor drum 15 has certainly passed the region of the developing bias voltage Vdc2, and this time T is set to, for example, 100 ms similarly to the start of charging. Incidentally, it is needless to say that the time T may be shorter or longer than 100 ms.

The important point of this embodiment is that the charged potential of the photoreceptor drum 15 is changed from the intermediate value Vh1 to 0 V with the falling of the developing bias voltage Vdc2 occurring in the region of the intermediate value Vh1.

Like this, the above embodiment is structured such that the developing bias voltage is changed from the intermediate value Vdc1 to the objective predetermined developing bias voltage Vdc2 with the rising of the charged potential of the photoreceptor drum 15 occurring in the region of the intermediate value. Further, the intermediate value Vdc1 of the developing bias voltage is set so that the potential difference between the potential (about 0 V) of the non-charged portion of the photoreceptor drum 15 and the developing bias voltage Vdc1 does not exceed the first predetermined value as the potential difference to cause the toner and carrier on the developing roll 55 to adhere to the surface of the photoreceptor drum 15, and the potential difference (−340

V) between the potential (−700 V) of the charged portion of the photoreceptor drum 15 and the developing bias voltage Vdc1 does not exceed the second predetermined value to cause the carrier on the developing roll 55 to adhere to the surface of the photoreceptor drum 15. Thus, in this embodiment, at the time of the rising of the charged potential of the photoreceptor drum 15, it is possible to certainly prevent the toner and the carrier from adhering to the surface of the photoreceptor drum 15. Further, in this embodiment, since the developing bias voltage needs only to be changed from the intermediate value Vdc1 to the objective predetermined developing bias voltage Vdc2 with the rising of the charged potential of the photoreceptor drum 15 occurring in the region of the intermediate value, it is not necessary to gradually change both the developing bias voltage and the charged potential of the photoreceptor drum 15 through plural stages. Thus, this embodiment can also be applied to a copying machine or printer having a high process speed.

EXPERIMENTAL EXAMPLES

The present inventors carried out an experiment to ascertain what degree of the intermediate value Vdc1 of the developing bias voltage can certainly prevent the toner and the carrier from adhering to the surface of the photoreceptor drum 15 when the developing bias voltage is changed from the intermediate value Vdc1 to the objective predetermined developing bias voltage Vdc2 with the rising of the charged potential of the photoreceptor drum 15 occurring in the region of the intermediate value of the developing bias voltage as shown in FIG. 1A.

An experimental condition is the same as the foregoing embodiment 1.

Figures 6A, 6B:
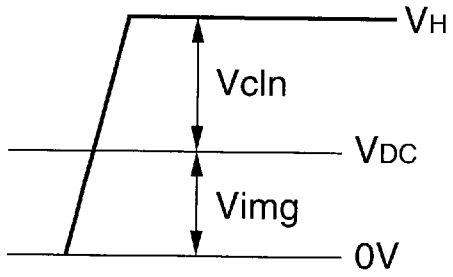
FIGS. 6A and 6B are diagrams showing an experimental result.

FIG. 6 shows the result of the experiment. It is understood that if the potential difference Vimg between the potential (about 0 V) of the non-charged portion of the photoreceptor drum 15 and the developing bias voltage VDC is 450 V or less, and the potential difference Vcln between the potential (−700 V) of the charged region of the photoreceptor drum 15 and the developing bias voltage VDC is also 450 V or less, the adhesion of toner and carrier to the surface of the photoreceptor drum 15 can be certainly prevented.

Figure 10A:
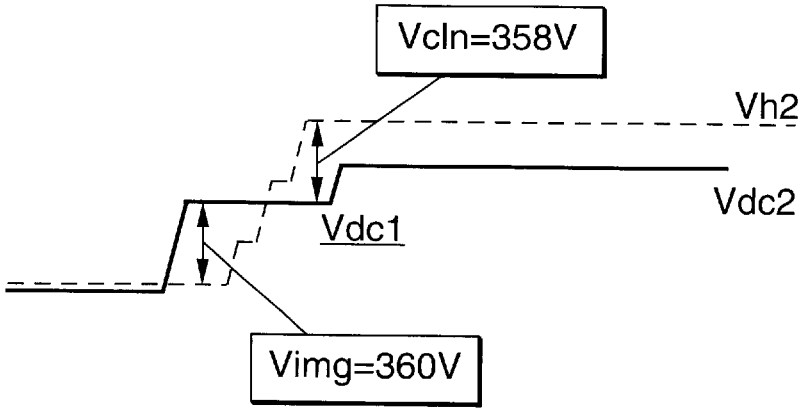
FIGS. 10A and 10B are timing charts respectively showing the operation of the potential controller of the image forming apparatus according to the embodiment 2 of the present invention.
Figure 10B:
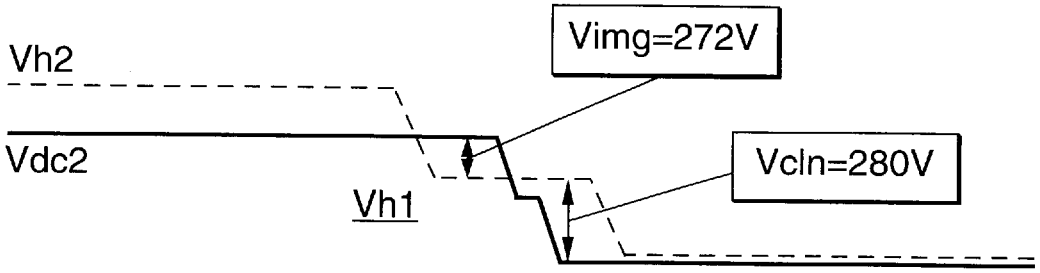

FIGS. 10A and 10B show examples in which both potentials are controlled. In this case as well, it becomes possible to make an excellent state. For example, it is also possible to change Vh2 as shown in FIG. 10A and to change Vdc2 of FIG. 10B in stages.

Comparative Experiment

Figure 9A:
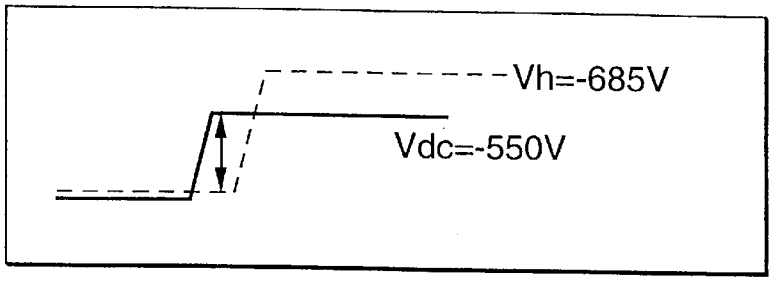
RELATED ART FIG.9A
FIGS. 9A to 9C are timing charts respectively showing the operation of a conventional potential controller of an image forming apparatus.
Figure 9B:
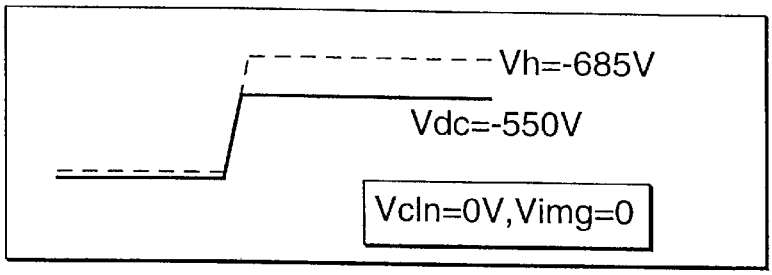
RELATED ART FIG.9B
Figure 9C:
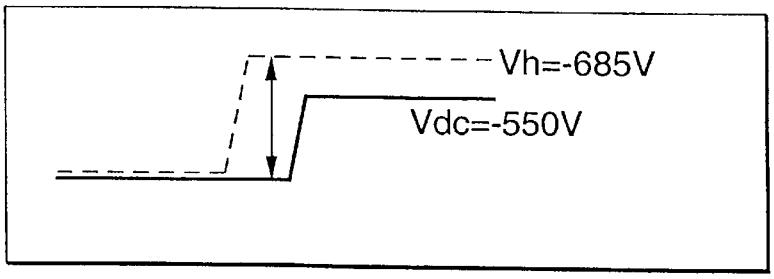
RELATED ART FIG.9C

Besides, the present inventors carried out an experiment to ascertain how the width of toners adhered to the surface of the photoreceptor drum 15 is changed when the rising of the developing bias voltage is temporally shifted from the rising of the charged potential of the photoreceptor drum 15 as shown in FIG. 9A or 9C.

Figure 7:
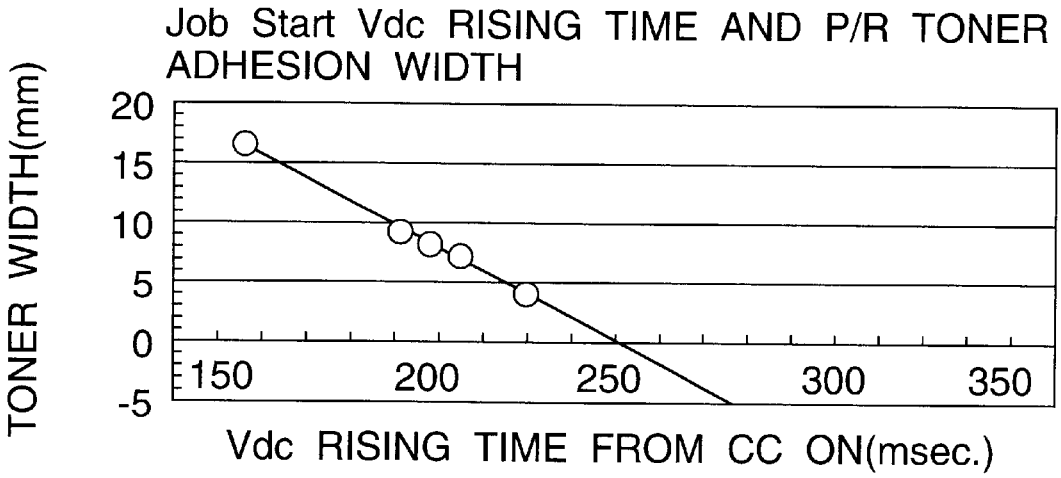
FIG. 7 is a graph showing an experimental result.

FIG. 7 shows the result of the experiment. In the case where the developing bias voltage and the charged potential of the photoreceptor drum 15 are immediately raised to a predetermined voltage and a potential without taking an intermediate value, it is understood that except for a very short timing when the rising of the developing bias voltage is coincident with the rising of the charged potential of the photoreceptor drum 15, the width of the toners adhered to the surface of the photoreceptor drum 15 is linearly increased at a large gradient. However, it is difficult (especially in a high speed machine) to control the application timing of both so that the rising of the developing bias voltage is coincident with the rising of the charged potential of the photoreceptor drum 15, and it is understood that the adhesion of the toner to the surface of the photoreceptor drum 15 can not be certainly prevented.

Embodiment 2

Figure 8A:
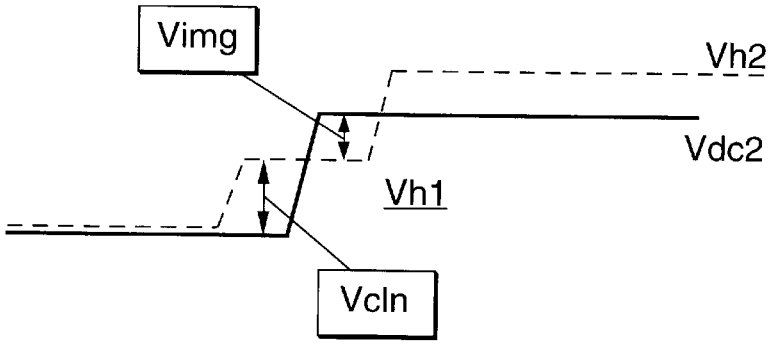
FIGS. 8A and 8B are timing charts respectively showing the operation of a potential controller of an image forming apparatus according to embodiment 2 of the present invention.
Figure 8B:
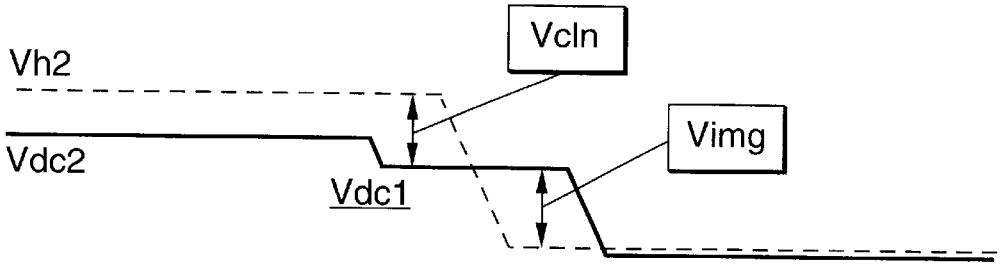

FIGS. 8A and 8B show embodiment 2 of the present invention, and the same portions as those of the embodiment 1 are designated by the same reference characters. In the embodiment 1, at the time of starting the image formation, the developing bias voltage is controlled through the plural stages, and at the time of stopping the image formation, the charged potential of the image bearing body is controlled through the plural stages. On the other hand, in this embodiment 2, at the time of starting the image formation, the charged potential of the photoreceptor drum is controlled through plural stages, and at the time of stopping the image formation, the developing bias voltage is controlled through plural stages.

That is, in this embodiment 2, in a digital color copying machine, in the case where formation of a full color or single color image is started, as shown in FIG. 4, with the start of image forming operation, rotation driving of the photoreceptor drum 15 is started, and AC voltage and DC voltage are applied to the primary charging scorotron 16 of each of the image forming units 13Y, 13M, 13C and 13K by the AC high voltage power source 80 and the DC high voltage power source 81. The surface of the photoreceptor drum 15 is uniformly charged, as shown in FIG. 8A, to a predetermined potential (for example, −700 V) through an intermediate potential Vh1 (for example, −300 V).

When the front end of the charged region of the intermediate potential Vh1 of the photoreceptor drum 15 is moved to the development region facing the developing roll 55 as the photoreceptor drum 15 is rotated, as shown in FIG. 8A, a predetermined developing bias voltage Vdc2 (for example, Vdc2=−550 V) is applied to the developing sleeve 59 of the developing unit 17 by the control circuit 85 at a timing later than the rising of the potential of the charged region of the photoreceptor drum 15. The intermediate potential Vh1 of the photoreceptor drum 15 is set so that the potential difference between the intermediate potential Vh1 of the photoreceptor drum 15 and the developing bias voltage does not exceed a first predetermined value, and the potential difference (−250 V) between the developing bias voltage Vdc2 and the intermediate potential Vh1 of the photoreceptor drum 15 does not exceed a second predetermined value. In this embodiment, the intermediate potential Vh1 of the photoreceptor drum 15 is set to, for example, −300 V as described above.

Thereafter, the control circuit 85 controls the DC high voltage power source 81 at a predetermined timing after the region of the intermediate potential Vh1 of the photoreceptor drum 15 passes the rising portion of the developing bias voltage with the rising portion of the developing bias voltage occurring in the region of the intermediate potential Vh1 of the photoreceptor drum 15, so that a predetermined voltage (for example, Vh2=−700 V) is applied to the primary charging scorotron 16.

Besides, in the digital color copying machine of this embodiment, in the case where one job of the full color or single color image formation is ended, as shown in FIG. 4, when the image forming operation is ended, the DC voltage and the DC voltage applied by the DC high voltage power source 80 and the DC high voltage power source 81 to the primary charging scorotron 16 of each of the respective image forming units 13Y, 13M, 13C and 13K are turned OFF, and charging to the surface of the photoreceptor drum 15 is finally stopped (0 V) as shown in FIG. 8B.

When the rear end of the charged region of the photoreceptor drum 15 is moved to the development region facing the developing roll 55 as the photoreceptor drum 15 is rotated, as shown in FIG. 8B, the potential of the developing roll 55 is changed by the control circuit 85 at a timing earlier than the falling of the potential of the charged region of the photoreceptor drum 15 to an intermediate value Vdc1 (for example, Vdc1=−360 V) of the developing bias voltage lower than the predetermined developing bias voltage Vdc2. The intermediate value Vdc1 of this developing bias voltage is set so that the potential difference between the intermediate value Vdc1 (−360 V) of the developing bias voltage and the potential (substantially 0 V) of the non-charged portion of the photoreceptor drum 15 does not exceed the first predetermined value, and the potential difference (−340V) between the potential (−700 V) of the charged portion of the photoreceptor drum 15 and the intermediate value Vdc1 of the developing bias voltage does not exceed the second predetermined value. In this embodiment, the intermediate value Vdc1 of the developing bias voltage is set to, for example, −360 V as described above.

Thereafter, the control circuit 85 controls the DC high voltage power source 82 at a predetermined timing after the region of the intermediate value Vdc1 of the developing bias voltage passes the falling portion (0 V) of the photoreceptor drum 15 with the falling portion of the photoreceptor drum 15 occurring in the region of the intermediate value Vdc1 of the developing bias voltage, so that the voltage applied to the developing roll 55 is turned OFF (0 V).

Like this, in the embodiment 2 as well, it is possible to certainly prevent the toner and the carrier from adhering to the surface of the photoreceptor drum 15, and this embodiment can also be applied to a copying machine or printer having a high process speed.

Incidentally, in the foregoing embodiments, the description has been made on the case where the developing bias voltage or the charged potential of the photoreceptor drum 15 is controlled in two stages, that is, one intermediate value is taken and control is made to the objective value. However, it is needless to say that the developing bias voltage or the charged potential of the photoreceptor drum 15 may be controlled through three or more stages, that is, two or more intermediate values are taken, and control is made to the objective value.

As described above, according to the present invention in which at least one potential is controlled, it is possible to provide a potential controlling method and potential controller of the image forming apparatus in which the adhesion of toner and carrier to the surface of the image bearing body at the time of start and stop of the image formation can be certainly prevented, and which can also be applied to an image forming apparatus having a high image forming speed.

What is claimed is:

1. A potential controller of an image forming apparatus having an image bearing body, a charging part that charges the surface of the image bearing body, an exposing part that exposes the surface of the image bearing body to form an electrostatic latent image, and a developing part that applies a developing bias voltage to a developer bearing body to develop the latent image, the potential controller, at the time of rising of a charged potential of the image bearing body and a developing bias voltage, controlling at least one of the charged potential of the image bearing body and the developing bias voltage to reach an objective value through plural stages with the rising of the other occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value.

2. A potential controller according to claim 1, wherein the potential controller, at the time of rising of a charged potential of the image bearing body and a developing bias voltage, controls one of the charged potential of the image bearing body and the developing bias voltage to reach an objective value through the plural stages with the rising of the other occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value.

3. A potential controller according to claim 2, wherein when an intermediate value of the charged potential of the image bearing body controlled to reach the objective value through the plural stages is VHn (V) (n=1 or more), the developing bias voltage is VD (V), and a potential when the developing bias voltage is turned OFF is VD0 (V), the charged potential of the image bearing body is controlled to reach the objective value through the plural stages so that the following relation is satisfied:

$$VD-VHn<450\ (V)$$

$$VHn-VD0<450\ (V).$$

4. A potential controller according to claim 1, wherein when the potential of the non-charged portion of the image bearing body is V0 (V), an intermediate value of the developing bias voltage controlled to reach the objective value through the plural stages is VDn (V) (n=1 or more), and the potential of the charged portion of the image bearing body is VH (V), the developing bias voltage is controlled to reach the objective value through the plural stages so that the following relation is satisfied:

$$VH-VDn<450\ (V)$$

$$VDn-VD0<450\ (V).$$

5. A potential controller according to claim 1, wherein the potential controller, at the time of falling of a charged potential of the image bearing body and a developing bias voltage, controlling the charged potential of at least one of the image bearing body and the developing bias voltage to reach an objective value through the plural stages with the rising of the other occurring through the stages, so that a potential difference between a potential of a noncharged portion of the image bearing body and the developing bias voltage does not exceed a third predetermined value, and a potential difference between a potential of a charged portion of the image bearing body and the developing bias voltage does not exceed a fourth predetermined value.

6. A potential controller of an image forming apparatus having an image bearing body, a charging part that charges the surface of the image bearing body, an exposing part that exposes the surface of the image bearing body to form an electrostatic latent image, and a developing part that applies a developing bias voltage to a developer bearing body to develop the latent image, the potential controller, at the time of rising or falling of a charged potential of the image bearing body and a developing bias voltage, controlling one of the charged potential of the image bearing body and the developing bias voltage to reach an objective value through the plural stages with the rising or falling of the other occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value, wherein when the potential of the non-charged portion of the image bearing body is V0 (V), an intermediate value of the developing bias voltage controlled to reach the objective value through the plural stages is VDn (V) (n=1 or more), and the potential of the charged portion of the image bearing body is VH (V), the developing bias voltage is controlled to reach the objective value through the plural stages so that the following relation is satisfied:

$$VH-VDn<450\ (V)$$

$$VDn-V0<450\ (V).$$

7. A potential controlling method for an image forming apparatus having an image bearing body, a charging part that charges the surface of the image bearing body, an exposing part that exposes the surface of the image bearing body to form an electrostatic latent image, and a developing part that applies a developing bias voltage to a developer bearing body to develop the latent image, the method comprising:

controlling, at the time of rising of a charged potential of the image bearing body and a developing bias voltage, at least one of the charged potential of the image bearing body and the developing bias voltage to reach an objective value through plural stages with the rising of the other occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value.

8. A potential controlling method according to claim 7, further comprising controlling, at the time of rising of a charged potential of the image bearing body and a developing bias voltage, one of the charged potential of the image bearing body and the developing bias voltage to reach an objective value through plural stages with the rising of the other occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value.

9. A potential controlling method according to claim 8, wherein when an intermediate value of the charged potential of the image bearing body controlled to reach the objective value through the plural stages is VHn (V) (n=1 or more), the developing bias voltage is VD (V), and a potential when the developing bias voltage is turned OFF is VD0 (V), the charged potential of the image bearing body is controlled to reach the objective value through the plural stages so that the following relation is satisfied:

$$VD-VHn<450\ (V)$$

$$VHn-VD0<450\ (V).$$

10. A potential controlling method according to claim 7, wherein when the potential of the non-charged portion of the image bearing body is V0 (V), an intermediate value of the developing bias voltage controlled to reach the objective value through the plural stages is VDn (V) (n−1 or more), and the potential of the charged potential of the image bearing body is VH (V), the developing bias voltage is controlled to reach the objective value through the plural stages so that the following relation is satisfied:

$$VH-VDn<450\ (V)$$

$$VDn-V0<450\ (V).$$

11. A potential controlling method according to claim 7, further comprising, at the time of falling of a charged potential of the image bearing body and a developing bias voltage, controlling the charged potential of at least one of the image bearing body and the developing bias voltage to reach an objective value through the plural stages with the rising of the other occurring through the stages, so that a potential difference between a potential of a non-charged portion of the image bearing body and the developing bias voltage does not exceed a third predetermined value, and a potential difference between a potential of a charged portion of the image bearing body and the developing bias voltage does not exceed a fourth predetermined value.

12. A potential controlling method for an image forming apparatus having an image bearing body, a charging part that charges the surface of the image bearing body, a exposing part that exposes the surface of the image bearing body to form an electrostatic latent image, and a developing part that applies a developing bias voltage to a developer bearing body to develop the latent image, the method comprising:

controlling, at the time of rising or falling of a charged potential of the image bearing body and a developing bias voltage, one of the charged potential of the image bearing body and the developing bias voltage to reach an objective value through plural stages with the rising or falling of the other occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value, wherein when the potential of the non-charged portion of the image bearing body is V0 (V), an intermediate value of the developing bias voltage controlled to reach the objective value through the plural stages is VDn (V) (n−1 or more), and the potential of the charged potential of the image bearing body is VH (V), the developing bias voltage is controlled to reach the objective value through the plural stages so that the following relation is satisfied:

$$VH-VDn<450\ (V)$$

$$VDn-V0<450\ (V).$$

13. A potential controller of an image forming apparatus having an image bearing body, a charging part that charges the surface of the image bearing body, an exposing part that exposes the surface of the image bearing body to form an electrostatic latent image, and a developing part that applies a developing bias voltage to a developer bearing body to develop the latent image, the potential controller, at the time of rising or falling of a charged potential of the image bearing body and a developing bias voltage, controlling the developing bias voltage to reach an objective value through plural stages with the rising or falling of the charge potential of the image bearing body occurring through the stages, so that a potential difference between a potential of a non-charged portion of the image bearing body and the developing bias voltage does not exceed a first predetermined value, and a potential difference between a potential of a charged portion of the image bearing body and the developing bias voltage does not exceed a second predetermined value.

14. A potential controller according to claim 13, wherein when an intermediate value of the charged potential of the image bearing body controlled to reach the objective value through the plural stages is VHn (V) (n=1 or more), the developing bias voltage is VD (V), and a potential when the developing bias voltage is turned OFF is VD0 (V), the charged potential of the image bearing body is controlled to reach the objective value through the plural stages so that the following relation is satisfied:

$$VD-VHn<450\ (V)$$

$$VHn-VD0<450\ (V).$$

15. A potential controller according to claim 13, wherein a variable DC bias voltage is applied to the developing part to vary the developing bias voltage between the first predetermined value and the objective value.

16. A potential controller according to claim 15, further comprising a DC high voltage power source for applying the variable DC bias voltage to the developing part.

17. A potential controller according to claim 16, wherein the potential controller controls the timings and the values of the DC high voltage power source.

18. A potential controller according to claim 15, wherein the DC bias voltage varies the developing bias voltage between the first predetermined value, the objective value, and at least one intermediate value between the first predetermined value and the objective value.

19. A potential controller according to claim 15, further comprising an AC bias voltage superimposed on the DC bias voltage.

20. A potential controller according to claim 19, wherein when the developing bias voltage from the AC component is in an OFF state, the DC bias voltage is applied to the developing part.

* * * * *